US005680730A

United States Patent [19]

Epple

[11] Patent Number: 5,680,730

[45] Date of Patent: Oct. 28, 1997

[54] EXTRUDED COPING FOR A SWIMMING POOL

[75] Inventor: Thomas A. Epple, Fort Wayne, Ind.

[73] Assignee: Fort Wayne Plastics, Inc., Fort Wayne, Ind.

[21] Appl. No.: 470,981

[22] Filed: Jun. 6, 1995

[51] Int. Cl.[6] ..... E04H 4/00

[52] U.S. Cl. ..... 52/28; 4/496; 52/169.7; 52/300; 362/145

[58] Field of Search ..... 52/168, 169.6, 52/169.7, 169.8, 716.2, 102, 28, 300; 362/147, 152, 151, 153.1; 4/506, 496, 510

[56] References Cited

U.S. PATENT DOCUMENTS

| | | | |
|---|---|---|---|
| 4,064,571 | 12/1977 | Phipps | 4/496 |
| 4,107,826 | 8/1978 | Tysdal | 4/506 X |
| 4,457,119 | 7/1984 | Dahowski | 4/506 X |
| 4,901,492 | 2/1990 | Coates | 52/300 |
| 5,107,551 | 4/1992 | Weir et al. | 4/506 X |
| 5,134,819 | 8/1992 | Boyack | 4/506 X |
| 5,170,517 | 12/1992 | Stegmeier | 4/506 X |

*Primary Examiner*—Michael Safavi
*Attorney, Agent, or Firm*—Taylor & Associates, P.C.

[57] ABSTRACT

The invention is directed to a coping for use in a swimming pool. A base is configured for connecting to a sidewall of the pool. A wall is connected to the base and includes a facia. The facia has a first slot for receiving and retaining a liner bead therein and a second slot for receiving and retaining a tube light therein. The first slot and the second slot extend substantially parallel to the longitudinal direction of the coping. The coping is of monolithic, metal construction. With the slot receiving the tube light having a circular cross-section. A coping clip is utilized to attach end-to-end coping pieces to one another with the clip extending from the top edge of the coping to the light receiving slot without obscuring the light receiving slot.

16 Claims, 2 Drawing Sheets

EXTRUDED COPING FOR A SWIMMING POOL

BACKGROUND OF THE INVENTION

1. Field of the invention

The present invention relates to copings for a swimming pool, and, more particularly, relates to extruded copings for a swimming pool.

2. Description of the Related Art

A coping for a swimming pool is disposed about the periphery of the pool and above water level. It is common for a coping to interconnect the sidewalls, pool liner and walkway of the pool. For example, a coping may include a bottom surface which is adapted for connection to a sidewall of the pool using appropriate fasteners, and a facia having a slot extending the longitudinal length thereof which receives a bead disposed at the top edge of the liner. The back of the coping, disposed opposite the facia, is adapted to receive and interconnect with concrete forming the walkway.

It is known to provide a light which is associated with a coping. The light provides increased aesthetic appeal to actual and prospective purchasers. The light can be configured, e.g., as a fiber optic or light emitting diode (LED) light source.

For example, it is known to provide a plastic extruded coping which is formed as a multiple-piece coping having a bead slot for receiving a liner bead, and an additional oval slot for receiving a fiber optic strip light. The strip light consists of a transparent plastic sheathing which is disposed in the oval slot of the coping, and a plurality of fibers which are disposed within the sheathing and connected to a remote light source.

A problem with plastic coping is that because of the inherent physical properties of the plastic from which the coping is made, the coping is relatively flimsy or weak in both a vertical direction substantially parallel to the facia, as well as a horizontal direction substantially transverse to the facia. The plastic coping thus tends to be rather non-linear or wavy along the longitudinal length thereof because of this inherent weakness. When a light is installed in the plastic coping and illuminated, the light correspondingly has a non-linear or wavy appearance which is aesthetically non-appealing. A solution to preventing this non-linear or wavy appearance of both the coping and light is to include additional support structure which is attached to and disposed behind the facia of the plastic coping. However, such additional support structure results in increased material and a more complicated extrusion die, with associated increased manufacturing costs.

Another problem associated with plastic coping is that it is relatively brittle and cannot be bent around corners of a swimming pool. The plastic coping is instead cut and a short angled piece is used to interconnect copings on adjacent sidewalls of the pool. The short angled piece is disposed at an obtuse angle with respect to each of the sidewalls of the pool, with a relatively abrupt angular transition therebetween. When the light is disposed within the light receiving slot of the coping, the light tends to escape or slide out of the slot at the transitions between adjacent coping pieces because of the relatively abrupt angular transitions.

A further problem associated with plastic coping is that it relatively quickly degrades when exposed to ultra-violet (UV) radiation of sunlight, resulting in cracking and yellowing of the coping. A solution is to include a UV inhibitor in the plastic composition; however, the UV inhibitor additive makes the plastic brittle and far more susceptible to breakage from impacts and the like.

A still further problem associated with plastic coping is that the oval slot which holds the strip light includes opposing lips at the facia for retaining the strip light in the coping. The bottom lip retains water in the oval slot, and, because of the relative weakness of the plastic material, may result in breakage of the bottom lip upon freezing and expansion of the water within the oval slot.

Yet another problem associated with plastic coping is that the plastic material is a poor conductor of heat and essentially acts as an insulator. If a light source other than a fiber optic light source is disposed in the oval slot, such as an LED or other type of strip light source, the coping may build up an unacceptable level of heat therein, thereby leading to further degradation of the plastic material.

Another problem associated with plastic copings is that the plastic may not withstand repetitive thermal expansion and contraction. As indicated above, plastic is a poor thermal conductor and therefore does not dissipate heat very well. It is thus possible for plastic coping to build up heat generated by either the sun or a strip light source to an unacceptable level. Such a build up of heat results in thermal expansion and contraction of the plastic, and may result in cracking of the plastic caused by fatigue failure.

A further problem associated with plastic coping is that the light receiving slot has an oval cross-section with the long axis disposed substantially vertically. It has been found in the field to be rather difficult to properly insert and seat the strip light within a light receiving slot having an oval cross-section.

It is thus apparent for the foregoing reasons that although plastic extruded coping having a light therein offers certain advantages, it also has many disadvantages which may be found objectionable.

It is also known to provide extruded copings which are formed from metal, e.g., aluminum. Metal copings provide the advantages of increased ability to withstand thermal expansion and contraction, resistance to UV radiation, and relatively high strength and rigidity. Conventional metal swimming pool copings may include a curved facia with a liner bead slot, but have not heretofore included a light receiving slot therein because of certain inherent physical properties which have been perceived as making such an application impossible.

For example, in contrast with plastic copings, metal copings are not cut at an angle to form the corners of the pool. Rather, a shorter piece of coping is typically bent at a predetermined radius and joined to each of the two pieces of coping extending along adjacent sides of the pool. However, as is intuitively apparent, a metal coping is much stronger and much more resistant to bending in a direction transverse to the facia, as compared to plastic coping. Conventional metal copings include structure which is disposed transverse to the facia because of the bead receiving slot, bottom flange for attachment to the sidewall of the pool, and top flange for attachment to the concrete walkway. Because of the structure disposed transverse to the facia and the inherent resistance of the metal to bending, forming a bent corner in conventional coping is difficult. Adding a light receiving slot with associated additional structure disposed transverse to the facia would further increase the difficulty of forming a bent corner.

Further, a rectangular slot having an axis disposed parallel to the facia of a metal piece tends to open up or increase in size in a direction corresponding to the longer axis of the slot if the metal piece is bent to form a corner. As applied to a metal coping, if a light receiving slot such as used in plastic coping were to be formed therein, it was perceived that such a slot would likewise increase in size when bent and therefore allow a light to fall out.

Because of the above-mentioned problems associated with metal copings, conventional light sources for use with metal copings have heretofore been in the form of a transparent plastic lighted tube having a flange extending therefrom which is received in the liner bead slot. The light is installed by hammering or otherwise inserting the flange into the liner bead slot after the liner bead is installed and the pool is filled with water. The installer typically bends over the side of the pool from the walkway to install the flange of the light into the liner bead slot, thus making the installation difficult. Further the plastic tube which is disposed adjacent to, rather than in, the metal coping is susceptible to damage from mechanical impact.

What is needed in the art is a coping which allows the use of light therein, while at the same time avoiding the problems of conventional plastic coping.

What is further needed in the art is a coping which allows the use of a light therein, and which is not constructed as a multiple-piece design.

SUMMARY OF THE INVENTION

The present invention provides a coping for a swimming pool which is a monolithic, metal extrusion allowing the use of a tube light, and which also allows the coping to be bent to form a corner while at the same time maintaining the light receiving slot disposed therein within tolerance.

The invention comprises, in one form thereof, a coping for use in a swimming pool. A base is configured for connecting to a sidewall of the pool. A wall is connected to the base and includes a facia. The facia has a first slot for receiving and retaining a liner bead therein and a second slot for receiving and retaining a tube light therein. The first slot and the second slot extend substantially parallel to the longitudinal direction of the coping. The coping is of monolithic, metal construction.

An advantage of the present invention is that the light receiving slot is configured to remain in tolerance when relatively tight corner bends are made.

Another advantage of the present invention is that the light receiving slot is configured such that it does not retain water therein, shields UV radiation from impacting the plastic tube light disposed therein, has a relatively high reflectivity, and is positioned in a downwardly, angled position such that light emitted from the light source reflects off the water in the pool.

A further advantage is that additional supporting structure is not required to maintain the coping and light receiving slot in a straight line.

A still further advantage is that a coping clip is provided which connects adjacent copings together in end-to-end fashion, while providing a visually apparent continuous illumination from the light receiving slot.

Yet a further advantage is that the inside of the light receiving slot may be optionally configured with a reflective surface to reflect light rays from the light source out of the slot.

A still further advantage is that the coping may be provided with a curved wall which allows thermal expansion and contraction.

A further advantage is that the coping is constructed to dissipate heat caused by an interior light source or the sun.

Another advantage is that the light receiving slot is configured with a generally circular cross-section which allows tighter corner bends and easier installation of the tube light.

An additional advantage is that the coping is constructed of metal which is not subject to UV degradation.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
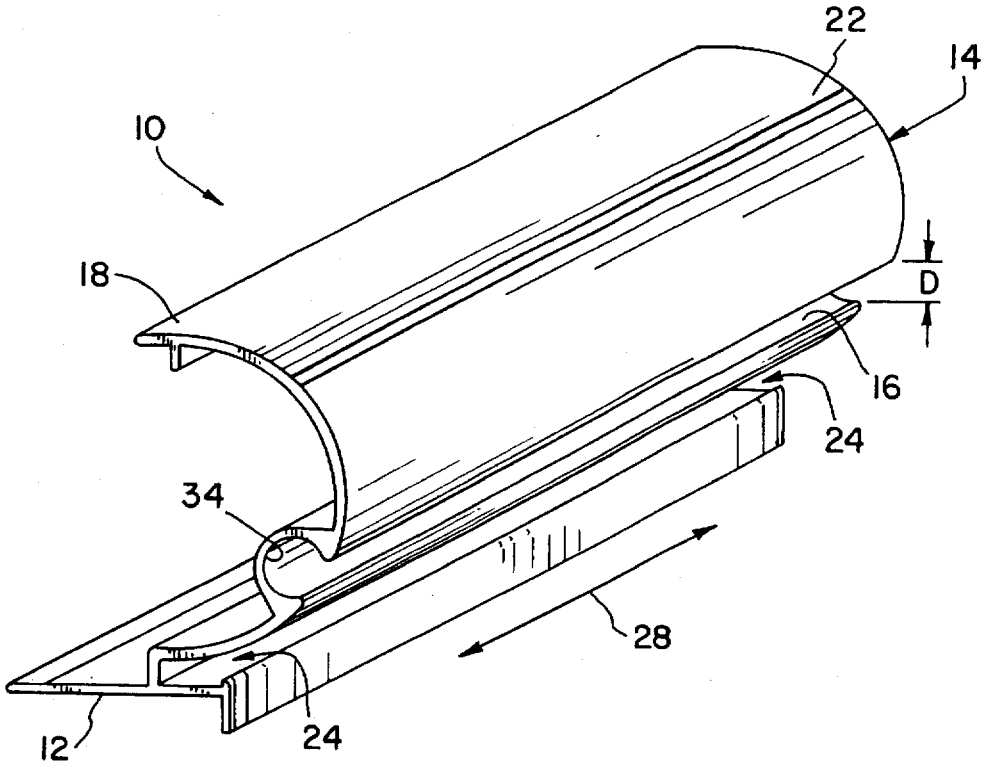
FIG. 1 is a perspective view of an embodiment of a coping of the present invention.
Figure 2:
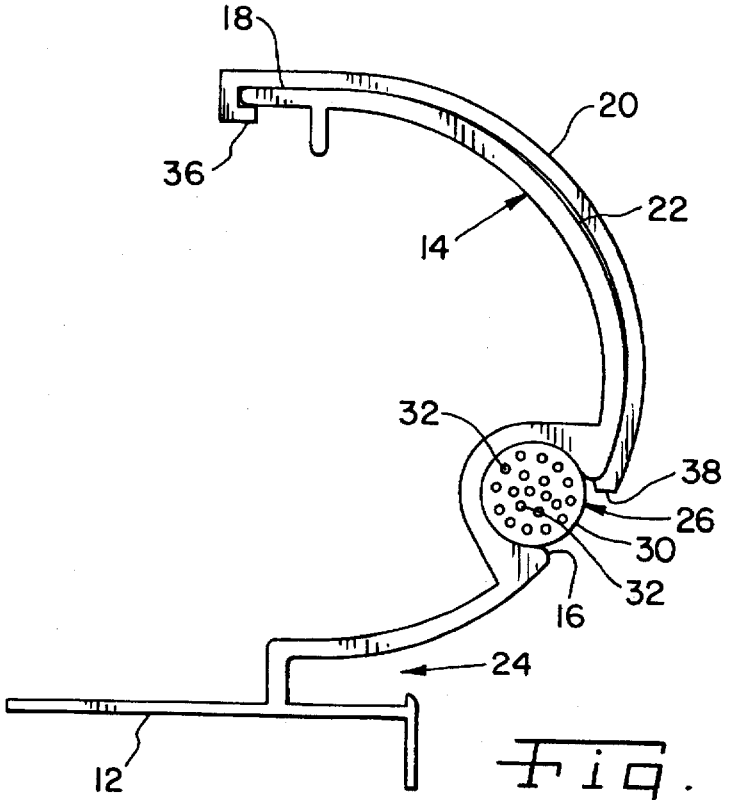
FIG. 2 is an end view of the coping shown in FIG. 1, with a coping clip and fiber optic light attached thereto.

Referring now to the drawings, and more particularly to FIGS. 1 and 2, there is shown an embodiment of a coping 10 of the present invention for use in a swimming pool (not shown). Coping 10 generally includes a base 12, wall 14, light receiving slot 16, top 18 and coping clip 20.

Base 12 is suitably configured for connecting to a sidewall of the pool. In the embodiment shown, base 12 is configured as a flange which may be bolted or otherwise attached to the top of the sidewall of the pool.

Wall 14 is connected to base 12 and includes top 18 and a facia 22. Facia 22 generally faces toward the inside of the swimming pool when assembled. Facia 22 has a first slot or liner bead receiving slot 24 for receiving and retaining a liner bead (not shown) therein. Facia 22 also has a second slot or light receiving slot 16 for receiving and retaining a light source therein, such as a tube light 26. Each of liner bead receiving slot 24 and light receiving slot 16 extend substantially parallel to a longitudinal direction (indicated by direction arrow 28) of coping 10.

Tube light 26 is a fiber optic tube light including a sheathing 30 having a plurality of fibers 32 disposed therein. Fibers 32 receive light from a light source (not shown), which may be remotely located. Fibers 32 may be illuminated with a single color of light, or may be illuminated with a plurality of colors of light, depending upon personal preferences.

Light receiving slot 16 is disposed in the bottom half of convex facia 22 and is directed in a downwardly, angled position. Positioning light receiving slot 16 in the bottom half of facia 22 inhibits mechanical damage to tube light 26, and further inhibits direct exposure of tube light 26 to sunlight. Since sheathing 30 and/or fibers 32 are likely formed from a plastic material, inhibiting exposure thereof to direct sunlight results in decreased damage caused by UV radiation. Further, by directing light from tube light 26 in a downwardly, angled direction, the majority of illuminated light from tube light 26 is not lost to the ambient environment, but rather is reflected off of the water in the swimming pool, thereby resulting in an increased aesthetic appeal to prospective and actual purchasers. Finally, as can be appreciated from FIG. 2, light receiving slot 16 is positioned such that water drains therefrom and is not retained therein, thereby eliminating the possibility of freezing and expansion of water within light receiving slot 16.

Light receiving slot 16 preferably has a generally circular cross-section which is sized for receiving tube light 26 therein. It has been found that the circular cross-section provides easier installation of the light source into light receiving slot 16, as contrasted with light receiving slots having other cross-sections such as oval, etc. Further, the generally circular cross-section of light receiving slot 16 allows the use of a tube light 26 having a corresponding circular cross-section with an increased cross-sectional surface area as compared to conventional strip and tube lights used with plastic coping. This allows a greater number of fibers 32 to be disposed within sheathing 30, with a resultant increased light output.

Light receiving slot 16 has an inside surface 34 (FIG. 1) which may be configured with a high reflectivity to increase the light output therefrom. For example, if coping 10 is formed from aluminum, inside surface 34 may be configured as a bare aluminum surface with a relatively smooth surface finish (as would result from extrusion) and a corresponding high reflectivity. Such a high reflectivity is not possible with conventional plastic material used in plastic coping. Alternatively, inside surface 34 can be painted or otherwise finished with a non-reflective surface.

Light receiving slot 16 is positioned on facia 22 and has a cross-sectional shape such that the dimension "D" (FIG. 1) extending across light receiving slot 16 remains in tolerance when coping 10 is bent to form a corner piece. More particularly, it has been found that providing light receiving slot 16 with a generally circular cross-section and placing light receiving slot 16 in the lower half of facia 22 results in the dimension D remaining within certain tolerances, thereby preventing tube light 26 from escaping from light receiving slot 16.

Figure 3:
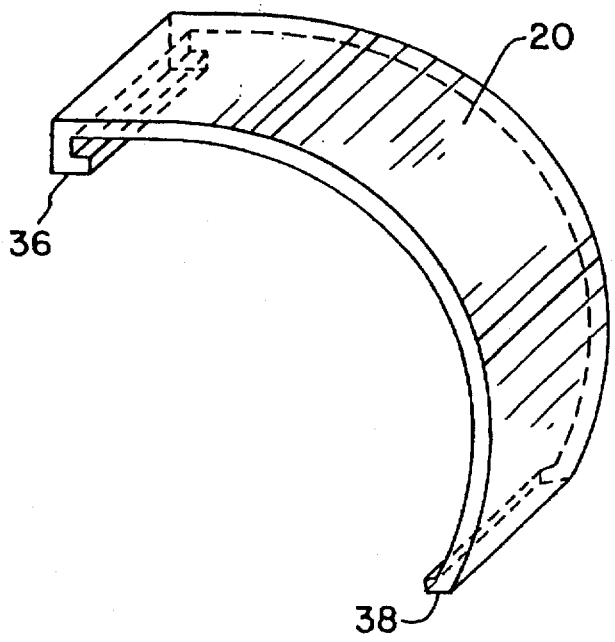
FIG. 3 is a perspective view of the coping clip shown in FIG. 2.
Figure 4:
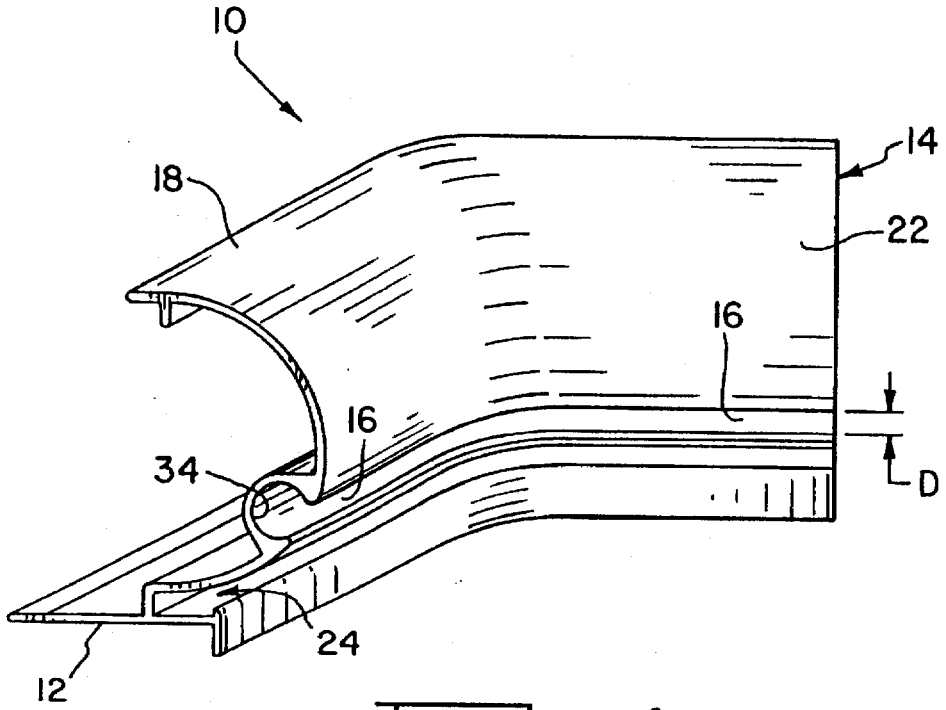
FIG. 4 is a perspective view of the coping shown in FIG. 1 formed as a corner piece.

Referring now to FIGS. 2 and 3, coping clip 20 of the present invention is shown in greater detail. Coping clip 20 includes a hooked end 36 which attaches to top 18, and a curved end 38 which attaches to light receiving slot 16. Coping clip 20 extends from top 18 to light receiving slot 16, without extending entirely over and obscuring light receiving slot 16. Tube light 26 therefore has a continuous appearance about the periphery of the swimming pool when disposed in light receiving slot 16 and illuminated. Such a feature may have increased aesthetic appeal to prospective and actual purchasers.

In contrast with conventional plastic coping, coping 10 of the present invention does not require additional structure disposed adjacent to light receiving slot 16 for preventing flexure of facia 22 in a vertical or horizontal direction. Rather, the configuration of coping 10 and the stiffness of the material from which coping 10 is constructed prevents flexure and ensures that tube light 26 appears substantially linear along the sidewalls of the swimming pool when illuminated. The resistance to flexure is further increased by the positioning of light receiving slot 16 on convex facia 22.

Further, the lack of additional structure disposed adjacent to light receiving slot 16 allows coping 10 to be more easily bent in the shape of a corner piece. More particularly, the additional structure typically used in plastic coping which is associated with the slot extends in a direction transverse to the facia of the coping, resulting in increased resistance to flexure in a direction transverse to the facia. As indicated above, a conventional metal coping can be difficult to bend to form a corner piece. If additional structure were used in a metal coping in association with light receiving slot 16, such as taught by conventional plastic coping, then the metal coping can be nearly impossible to properly bend, or may kink during bending. The lack of additional structure in the coping of the present invention allows coping 10 to be more easily bent to form a corner piece.

Facia 22 has a curved or convex shape, but may be differently shaped. As will be appreciated, top 18 and base 12 are rigidly affixed to the walkway and side wall of the pool, respectively. The convex shape of facia 22, in conjunction with the presence of light receiving slot 16 in facia 22, allows for thermal expansion and contraction of wall 14 caused by the sun and/or light source disposed within light receiving slot 16. That is, since wall 14 is rigidly fixed at the top and bottom thereof, the convex shape of facia 22 allows for thermal expansion and contraction in a generally sideways direction, i.e., perpendicular to longitudinal direction 28.

In the embodiment shown, coping 10 is of a monolithic, metal construction and is formed by the process of extrusion. Coping 10 may thus be relatively easily fabricated. It is to be understood, however, that coping 10 could be formed by processes, such as molding, etc.

Further, in the embodiment shown, tube light 26 is a fiber optic tube light. However, it is to be understood that other light sources can be utilized, e.g., LED tube light, etc.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coping for use in a swimming pool, said coping having a longitudinal direction, said coping comprising:

a base including means for connecting to a sidewall of the pool; and a wall connected to said base and including a facia, said facia having a first slot for receiving and retaining a liner bead therein and a second slot for receiving and retaining a tube light therein, each of said first slot and said second slot extending substantially parallel to said longitudinal direction, said wall including a top; and a coping clip extending from and attached to each of said top and said second slot, without extending entirely over said second slot.

2. The coping of claim 1, wherein said second slot has an inside surface with a high reflectivity.

3. The coping of claim 1, wherein said coping is formed by the process of extrusion.

4. A coping for use in a swimming pool, said coping having a longitudinal direction, said coping comprising:

a base including means for connecting to a sidewall of the pool;

a wall connected to said base, said wall including a facia and a top, said facia having a light receiving slot for receiving and retaining a tube light therein, said light receiving slot extending substantially parallel to said longitudinal direction; and a coping clip extending from and attached to each of said top and said light receiving slot, without extending entirely over said light receiving slot.

5. The coping of claim 4, wherein said coping has a monolithic, metal construction.

6. A coping assembly for use in a swimming pool, said coping assembly comprising:

a tube light; and a coping having a longitudinal direction, said coping including:

a base including means for connecting to a sidewall of the pool; and a wall connected to said base and including a facia, said facia having a light receiving slot defining a slot-shaped opening in said facia, said tube light being disposed and retained within said light receiving slot, said light receiving slot extending substantially parallel to said longitudinal direction, said slot-shaped opening being positioned to open in a downwardly, angled direction, thereby causing light from said tube light to be projected in a downwardly, angled direction.

7. The coping of claim 6, wherein said light receiving slot defines a means for preventing damage to the tube light, directing rays from the light in a downwardly, angled direction, and allowing water to drain from within said light receiving slot.

8. The coping of claim 6, wherein said light receiving slot has a substantially circular cross-section.

9. The coping of claim 8, wherein said coping has an absence of additional structure associated with said light receiving slot on a side of said wall opposite said facia.

10. The coping of claim 6, further comprising a bead receiving slot extending substantially parallel to said longitudinal direction.

11. The coping of claim 6, wherein said wall includes a top, and further comprising a coping clip extending from and attached to each of said top and said light receiving slot, without extending entirely over said light receiving slot.

12. The coping of claim 6, wherein said coping has a monolithic, metal construction.

13. A coping assembly for use in a swimming pool, said coping assembly comprising:

a tube light; and a coping including:

a base including means for connecting to a sidewall of the pool; and a wall connected to said base and including a facia, each of said base and said wall having a longitudinal extension and defining a corner piece which is curved along said longitudinal extension, said facia having a light receiving slot, said tube light being disposed and retained within said light receiving slot, said light receiving slot extending substantially parallel to said longitudinal extension, said light receiving slot having a substantially circular cross-section.

14. The coping of claim 13, further comprising a liner bead receiving slot extending substantially parallel to said longitudinal direction.

15. The coping of claim 13, wherein said coping has a monolithic, metal construction.

16. The coping of claim 13, wherein said coping is formed by the process of extrusion.

* * * * *